United States Patent [19]

Reding et al.

[11] 3,974,055

[45] Aug. 10, 1976

[54] ALUMINUM ALLOY ANODE COMPOSITION

[75] Inventors: John Thomas Reding; Robert Lee Riley, Jr., both of Lake Jackson, Tex.

[73] Assignee: The Dow Chemical Company, Midland, Mich.

[22] Filed: Dec. 23, 1974

[21] Appl. No.: 535,521

[52] U.S. Cl. ..... 204/197; 204/148; 204/293; 75/146

[51] Int. Cl.[2] ..... C23F 13/00; C22C 21/10

[58] Field of Search ..... 204/148, 197, 293; 75/146

[56] References Cited

UNITED STATES PATENTS

| | | | |
|---|---|---|---|
| 3,019,101 | 1/1962 | Colwell | 75/146 |
| 3,172,760 | 3/1965 | Sakand et al. | 75/146 |
| 3,418,230 | 12/1968 | Rutemiller | 204/197 |
| 3,496,085 | 2/1970 | Reding | 204/197 |

OTHER PUBLICATIONS

Sakano et al., "Materials Protection," Dec. 1966, pp. 45–50.

Reding et al., "Materials Protection," Dec. 1966, pp. 15–18.

*Primary Examiner*—T. Tung
*Attorney, Agent, or Firm*—Walter J. Lee

[57] ABSTRACT

Aluminum alloys prepared from commercial grade aluminum and containing minor amounts of indium and zinc, useful as galvanic anodes, are improved by the addition of a small amount of silicon.

4 Claims, No Drawings

ALUMINUM ALLOY ANODE COMPOSITION

BACKGROUND OF THE INVENTION

Aluminum alloys containing indium and/or zinc are used commercially as sacrificial galvanic anodes for protecting ferrous metals from electrolytic attack. Such alloys, containing indium and/or zinc, are disclosed in, e.g., U.S. Pat. No. 3,172,760; U.S. Pat. No. 3,418,230; U.S. Pat. No. 1,997,165; U.S. Pat. No. 3,227,644; U.S. Pat. No. 3,312,545; U.S. Pat. No. 3,616,420; U.S. Pat. No. 2,023,512; and U.S. Pat. No. 2,565,544.

In the December, 1966 issue of *Materials Protection* there are two publications which contain teachings of Al-In-Zn alloys for use as galvanic anodes. One publication is entitled "The Influence of Alloying Elements on Aluminum Anodes in Sea Water", pp. 15–18. The other publication is entitled "Tests on the Effects of Indium for High Performance Aluminum Anodes", pp. 45–50. These publications imply, as do various patents named above, that best results are obtained by the use of high purity aluminum in the Al-In-Zn alloys and that impurities in the aluminum are detrimental unless properly controlled.

U.S. Pat. No. 3,496,085 pertains to an aluminum anode containing minor amounts of mercury and zinc in which silicon is present in an amount in excess of the normal impurity level. The amounts of silicon and iron are controlled within certain ranges and ratios.

It is well known that the principal impurities normally found in aluminum are iron, silicon, and copper. It is generally felt by practitioners of the galvanic anode art, that best results are attained by holding the amount of these naturally occurring impurities to a very low level of concentration. It is generally believed that anodes prepared from high purity aluminum (about 99.99% purity) give better performance than anodes prepared from commercial grade aluminum (about 99.8 to about 99.9% purity).

SUMMARY OF THE INVENTION

It has now been found that the performance of aluminum alloys containing commercial grade aluminum along with minor amounts of indium and zinc, when used as sacrificial galvanic anodes for protecting ferrous metals, are improved by increasing the amount of one of the impurities (viz, silicon) normally found in aluminum so as to obtain a final Si content of at least about 0.07%.

More specifically, it has been found that by adding from about 0.03 to about 0.4% Si to an alloy prepared from commercial grade Al and containing, as additives, about 0.01 to about 0.06% In, and about 0.5 to about 15.0% Zn, that the performance of the alloy as a galvanic anode for protecting ferrous structures is improved. The commercial grade aluminum is one which contains, as naturally occurring impurities, about 0.02 to about 0.08% Si, about 0.02 to about 0.1% Fe, and less than about 150 ppm Cu. The total amount of Si present in the final alloy (including both natural and added Si) should be at least about 0.07%. Throughout this disclosure, all percents given are weight percents.

DETAILED DESCRIPTION OF THE INVENTION

Al alloys exhibiting good performance as sacrificial galvanic anodes in the cathodic protection of ferrous structures are obtained with commercial grade aluminum having alloyed therewith, as additives, about 0.01 to about 0.06% In, about 0.5 to about 15.0% Zn, and about 0.03 to about 0.4% Si. Commercial grade aluminum is defined herein as aluminum containing, as naturally occurring impurities, about 0.02 to about 0.08% Si, about 0.02 to about 0.1% Fe, less than about 150 ppm Cu and other minor impurities.

The invention is also defined as an improvement in preparing aluminum-indium-zinc alloys, useful as a galvanic anode material, said aluminum being of commercial grade, said indium being present in an amount of between about 0.01 to 0.06% and said zinc being present in an amount of between about 0.5 to 15.0%, wherein said improvement comprises adding silicon in the amount of between about 0.03 to about 0.4% to achieve a final Si content of at least about 0.07%.

Preferably the alloys of the present invention comprise commercial grade aluminum having alloyed therewith about 0.01 to about 0.03% In, about 1.0 to about 8.0% Zn, and about 0.05 to about 0.15% Si, said commercial grade aluminum having a purity of from about 99.8 to about 99.9% and as naturally occurring impurities, not more, each, than about 0.1% Fe, about 0.08% Si, about 0.015% Cu, and other minor impurities.

Most preferably, the alloys of the present invention comprise commercial grade aluminum having a purity within the range of 99.8 to 99.9% having added thereto about 0.01 to about 0.02% In, about 2.0 to about 6.0% Zn, and about 0.08 to about 0.13% Si, wherein said commercial grade Al contains as naturally occurring impurities, not more than about 0.08% Fe, not more than about 0.05% Si and not more than about 0.01% Cu, along with other minor impurities.

It will be readily understood, by practitioners of the present art that it is quite difficult to prepare alloys which, by analysis, prove to have the exact concentrations of alloying ingredients which were charged into the alloying mixture. This is due, in part, to the fact that some of the ingredients may be lost through evaporation or in being transfered from one vessel to another. It is also due, in part, to the fact that analysis of such alloys is difficult and measurements by emission spectroscopy (or mass spectroscopy) often have a fairly wide range for percent of error, depending on the amount of interference from co-ingredients in the alloy. In the examples which follow, the nominal analysis of the starting Al metal is determined prior to the addition of the In, Zn and Si. Following the addition of the In, Zn and Si (if any), another analysis is made to determine the amount of In, Zn, and Si (if any added), in the final alloy. The results reported are nominal amounts except where noted, said nominal amounts being the average of two or more specimens. In the following examples, the starting Al metal was analyzed and found to have the following naturally occurring impurities:

| Metal No. | Purity Range, % | Amounts of Impurities, % (nominal) Si | Fe | Cu | Other Impurities |
|---|---|---|---|---|---|
| A-1 | 99.8–99.9 | 0.047 | 0.063 | <0.0011 | <0.02 |
| A-2 | " | 0.058 | 0.068 | " | " |
| A-3 | " | 0.050 | 0.073 | " | " |
| A-4 | " | 0.042 | 0.069 | " | " |
| A-5 | " | 0.042 | 0.054 | " | " |
| A-6 | " | 0.046 | 0.072 | " | " |
| A-7 | " | 0.034 | 0.051 | " | " |
| A-8 | " | 0.040 | 0.046 | " | " |
| A-9 | " | 0.025 | 0.043 | " | " |

PREPARATION AND TESTING OF THE AL ALLOYS

About 665 parts of the starting Al is heating in a graphite crucible to a temperature of 750°C. The appropriate amount of In, Zn and Si are added to the molten Al and stirred well to assure as complete mixing as is feasibly possible. The molten alloy is poured into heated steel molds to obtain round anode specimens 6 inches long and ⅝-inches in diameter. The specimens are cleaned, dried, weighed and placed in an electric circuit. The circuit consists of a direct current supply, a milliammeter, a copper coulometer and a test cell. The test cell employs the Al alloy specimens as anodes, stainless steel rods as cathodes, and seawater as electrolyte. The length of each anode in the electrolyte is approximately 2½ inches. The cell container is plexiglass. A 2000 ohm resistor is placed in each wire connected to an anode to equalize the current. Current is passed through the circuit for one month during which time weekly potential measurements are obtained on the test speciments using a saturated calomel reference electrode. The current of 6.3 ma results in an anodic current density of approximately 180 ma/ft². At the end of the test, the specimens are removed from the cell, washed in water, cleaned in a 5% phosphoric acid/2% chromic acid solution at 80°C, washed with water, dried and weighed. The number of ampere hours passed through the specimens is obtained by measuring the gain in weight of the coulometer wire. The current capacities of the test specimens are are calculated by dividing the number of ampere hours passed through them by their weight losses.

EXAMPLES 1 through 36

The examples shown in the following chart of data (Table I) were run in accordance with the method described hereinbefore. In Table I the "target" amount of In, Zn, and Si added is shown as "% add."; the amount analyzed in the final alloy is shown as "% anal.". In the "Alloy performance" columns the Anode Potential is given as voltage as measured with a saturated calomel reference electrode and the Anode Current Capacity is given as amp hrs./lb. Where the data numbers are averages of closely grouped numbers, only the average number is shown. Where the data spread is too great to give a representative average, the data range is shown. Voltages below about 0.99 are only marginally operable under the conditions of the test, such low voltages being due to a tendency of those alloys, which contain low percent of In and High percent of Si, to become passivated.

Table I

| Example Number | Metal No. | Indium % Add. | Indium % Anal. | Zinc % Add. | Zinc % Anal. | Silicon % Add. | Silicon % Anal.** | Alloy Performance Anode Potential | Alloy Performance Current Capacity |
|---|---|---|---|---|---|---|---|---|---|
| 1 | A-1 | 0.01 | 0.011 | 0.5 | 0.45 | 0 | (0.047) | 1.11 | 1106 |
| 2 | " | " | 0.011 | " | 0.54 | 0.05 | 0.083 | .83–1.09 | 915–1110 |
| 3 | " | " | 0.010 | " | 0.55 | 0.10 | 0.12 | passivated | N.S.* |
| 4 | " | " | 0.012 | " | 0.62 | 0.20 | 0.19 | passivated | N.S.* |
| 5 | A-2 | 0.01 | 0.013 | 2.0 | 1.4 | 0 | (0.058) | 1.10 | 1093 |
| 6 | " | " | 0.012 | " | 1.5 | 0.05 | 0.077 | .99–1.10 | 1152–1147 |
| 7 | " | " | 0.012 | " | 1.6 | 0.10 | 0.120 | passivated | N.S.* |
| 8 | " | " | 0.010 | " | 1.4 | 0.20 | 0.20 | passivated | N.S.* |
| 9 | A-3 | 0.01 | 0.015 | 5.0 | 4.8 | 0 | (0.050) | 1.09 | 1104 |
| 10 | " | " | 0.015 | " | 4.8 | 0.05 | 0.082 | .81–1.09 | 1190–1160 |
| 11 | " | " | 0.010 | " | 4.9 | 0.10 | 0.13 | 1.08 | 1180 |
| 12 | " | " | 0.012 | " | 4.8 | 0.20 | 0.17 | 1.07 | 1178 |
| 13 | A-4 | 0.03 | 0.034 | 0.5 | 0.6 | 0 | (0.042) | 1.12 | 846 |
| 14 | " | " | 0.028 | " | 0.56 | 0.05 | 0.084 | 1.00–1.12 | 969 |
| 15 | " | " | 0.035 | " | 0.58 | 0.10 | 0.13 | 1.12 | 986 |
| 16 | " | " | 0.028 | " | 0.53 | 0.20 | 0.19 | 1.00–1.11 | 1061 |
| 17 | A-5 | 0.03 | 0.040 | 2.0 | 1.4 | 0 | (0.042) | 1.04–1.11 | 865 |
| 18 | " | " | 0.024 | " | 1.4 | 0.05 | 0.09 | 1.00–1.07 | 1035 |
| 19 | " | " | 0.027 | " | 1.5 | 0.10 | 0.12 | 1.09 | 1054 |
| 20 | " | " | 0.052 | " | 1.6 | 0.20 | 0.13 | 1.07 | 989 |
| 21 | A-6 | 0.03 | 0.048 | 5.0 | 4.6 | 0 | (0.046) | 1.07 | 941 |
| 22 | " | " | 0.030 | " | 4.1 | 0.05 | 0.076 | 1.08 | 1034 |
| 23 | " | " | 0.037 | " | 4.6 | 0.10 | 0.12 | 1.05 | 1083 |
| 24 | " | " | 0.030 | " | 3.8 | 0.20 | 0.15 | 1.09 | 1119 |
| 25 | A-7 | 0.06 | 0.075 | 0.5 | 0.63 | 0 | (0.034) | 1.14 | 659 |
| 26 | " | " | 0.054 | " | 0.45 | 0.05 | 0.062 | 1.14 | 834 |
| 27 | " | " | 0.047 | " | 0.44 | 0.10 | 0.065 | 1.14 | 873 |
| 28 | " | " | 0.060 | " | 0.50 | 0.20 | 0.15 | 1.12 | 1024 |
| 29 | A-8 | 0.06 | 0.036 | 2.0 | 1.1 | 0 | (0.040) | 1.13 | 533 |
| 30 | " | " | 0.050 | " | 1.1 | 0.05 | 0.072 | 1.11 | 839 |
| 31 | " | " | 0.070 | " | 1.2 | 0.10 | 0.10 | 1.13 | 690 |
| 32 | " | " | 0.074 | " | 1.3 | 0.20 | 0.15 | 1.11 | 973 |
| 33 | A-9 | 0.06 | 0.040 | 5.0 | 2.2 | 0 | (0.025) | 1.09 | 523 |
| 34 | " | " | 0.064 | " | 3.4 | 0.05 | 0.078 | 1.07 | 867 |
| 35 | " | " | 0.090 | " | 3.6 | 0.10 | 0.11 | 1.07 | 768 |
| 36 | " | " | 0.080 | " | 3.1 | 0.20 | 0.16 | 1.05 | 856 |

*N.S. means not significant because specimen passivated

**Analyses in parentheses are from analysis of starting Al metal

EXAMPLES 37–40

The alloys in these examples were prepared essentially as described in the previous examples. The testing, however, is different in that actual field conditions were employed and the electrolyte was a natural flowing seawater environment. The data is shown in Table II. The starting aluminum was commercial grade of 99.9% purity.

Table II

| Example Number | % Si added* | Nominal Composition* % In | % Zn | % Si | Test Conditions Time Tested (days) | Current Density (ma/ft²) | Anode Performance Pot.** (volts) | Current Capacity (Amp hr per lb.) |
|---|---|---|---|---|---|---|---|---|
| 37 | 0 | 0.02 | 5.0 | 0.05 | 392 | 172 | 1.06 | 785 |
| 38 | 0 | 0.02 | 5.0 | 0.05 | 396 | 171 | 1.06 | 778 |
| 39 | 0.10 | 0.02 | 5.0 | 0.15 | 392 | 175 | 1.08 | 1150 |
| 40 | 0.10 | 0.02 | 5.0 | 0.15 | 396 | 196 | 1.09 | 1159 |

*amounts given are "target" amounts, except for the Si amountof 0.05% which is nominal amount by analysis.
**potential as measured using a saturated calomel referenceelectrode.

EXAMPLES 41–52

In the following Table III the aluminum having a purity of about 99.7% contained, as natural impurities, about 0.16% Fe, about 0.09% Si, <about 150 ppm Cu, and less than about 200 ppm of other naturally-occurring impurities. The aluminum having a purity of about 99.9% contained, as natural impurities about 0.03% Fe, about 0.04% Si, about <50 ppm Cu, and less than 200 ppm of other natural impurities. The amounts of In, Zn, and Si are the "target" amounts added. The alloys were prepared and tested substantially in accordance with the procedure described for Examples 1–36.

Table III

| Example Number | Al % Purity | Additives % In | % Zn | % Si | Potential (volts) | Current Capacity (amp hrs/lb) |
|---|---|---|---|---|---|---|
| 41 | ~99.7 | 0.02 | 5.0 | 0 | 1.08 | 1030 |
| 42 | " | 0.02 | 5.0 | 0.05 | 1.07 | 1025 |
| 43 | " | 0.02 | 5.0 | 0.10 | 1.08 | 1025 |
| 44 | " | 0.03 | 5.0 | 0 | 1.09 | 995 |
| 45 | " | 0.03 | 5.0 | 0.05 | 1.08 | 1000 |
| 46 | " | 0.03 | 5.0 | 0.10 | 1.09 | 1015 |
| 47 | ~99.9 | 0.02 | 5.0 | 0 | 1.09 | 1120 |
| 48 | " | 0.02 | 5.0 | 0.05 | 1.09 | 1140 |
| 49 | " | 0.02 | 5.0 | 0.10 | 1.09 | 1145 |
| 50 | " | 0.03 | 5.0 | 0 | 1.09 | 1005 |
| 51 | " | 0.03 | 5.0 | 0.05 | 1.10 | 1115 |
| 52 | " | 0.03 | 5.0 | 0.10 | 1.10 | 1120 |

It has been found that when commercial grade Al of about 99.8 to 99.9% purity is employed, good voltages and improved current capacities are generally attained by the present invention. Also, excellent corrosion patterns are attained which is important in having a long-lived, efficient anode. When Al of only about 99.7% is employed, the voltages and corrosion patterns are good, but improved current capacities are not generally attained. When high purity Al (i.e., about 99.99% purity) is employed, the addition of Si (so as to reach a total Si content of at least 0.07%) is detrimental and poor corrosion patterns are encountered.

We claim:

1. An aluminum alloy useful as a sacrificial galvanic anode in the cathodic protection of ferrous structures, said aluminum alloy comprising:

a commercial grade of aluminum of 99.8 to about 99.9% purity containing, as naturally-occurring impurities about 0.02 to about 0.08% Si, about 0.02 to about 0.1% Fe, less than about 150 ppm Cu and minor amounts of other naturally-occurring impurities;

an amount of added indium in the range of about 0.01 to about 0.06% by weight of the total alloy weight;

an amount of added zinc in the range of about 0.5 to about 15.0% by weight of the total alloy weight; and an amount of added silicon in the range of about 0.03 to about 0.4% by weight of the total alloy weight, the amount of added silicon plus the naturally-occurring silicon being at least about 0.07%.

2. The alloy of claim 1 wherein the amount of added indium is in the range of about 0.01 to about 0.03%, the amount of added zinc is in the range of about 1.0 to about 8.0%, and the amount of added silicon is in the range of about 0.05 to about 0.15%.

3. The alloy of claim 1 wherein the amount of added indium is in the range of about 0.01 to about 0.02%, the amount of added zinc is in the range of about 2.0 to about 6.0%, the amount of added silicon is in the range of about 0.08 to about 0.13%, and where the commercial grade aluminum contains, as naturally occurring impurities, not more than about 0.08% iron, not more than about 0.05% silicon, not more than about 0.01% copper, and other naturally-occurring minor impurities.

4. A method for improving the performance of aluminum-indium-zinc anodes, said anodes being prepared by alloying about 0.01 to about 0.06% indium and about 0.5 to about 15.0% zinc, based on total alloy weight, with a commercial grade aluminum of about 99.8 to about 99.9% purity containing as naturally-occurring impurities about 0.02 to about 0.08% Si, about 0.02 to about 0.1% Fe, less than about 150 ppm Cu, and minor amounts of other naturally-occurring impurities, said method comprising also alloying with said anode an additional amount of silicon in the range of about 0.03 to about 0.4% Si, said additional amount being in addition to the amount of naturally-occurring Si, so as to attain a total content of silicon, both added and naturally-occurring, of at least about 0.07% in the anode.

* * * * *